United States Patent [19]

Olander et al.

[11] 4,402,774

[45] Sep. 6, 1983

[54] PYROTECHNIC COMPOSITION

[75] Inventors: Donald E. Olander, Huntington Beach; Donald W. Petersen, Tehachapi, both of Calif.

[73] Assignee: Hi-Shear Corporation, Torrance, Calif.

[21] Appl. No.: 323,436

[22] Filed: Nov. 20, 1981

[51] Int. Cl.[3] ..... C06B 45/10

[52] U.S. Cl. ..... 149/19.3; 149/19.9; 149/42; 149/44; 149/85

[58] Field of Search ..... 149/19.3, 19.9, 44, 149/42, 85

[56] References Cited

U.S. PATENT DOCUMENTS

| | | | |
|---|---|---|---|
| 2,500,097 | 3/1950 | Soffel | 149/44 |
| 3,803,074 | 2/1967 | Schwoyer | 149/44 |

*Primary Examiner*—Stephen J. Lechert, Jr.
*Attorney, Agent, or Firm*—Donald D. Mon

[57] ABSTRACT

A pyrotechnic composition comprising a mixture of finely divided magnesium and silicon dioxide, both distributed throughout a binder selected from the members of the group consisting of polybutadienes and teflon. The composition is suitably insensitive, and yet readily ignitable, and does not require the use of solvents or of expensive spheroidal magnesium granules for its manufacture.

7 Claims, No Drawings

PYROTECHNIC COMPOSITION

FIELD OF THE INVENTION

This invention relates to pyrotechnic compositions which utilize the reaction between magnesium and silicon dioxide.

BACKGROUND OF THE INVENTION

Many attempts have been made effectively to utilize the reaction between magnesium and silicon dioxide for the manufacture of incendiaries. All such attempts, however, have included the use of other oxidizers to initiate the burning of the magnesium. Oxidizers such as potassium perchlorate in the presence of polyphenoxysiloxane rubber have a three-fold drawback. First, the resultant material is too sensitive for use in high set-back applications such as artillery shells. Second, the quantity of silicon dioxide produced was insufficient to react with a substantial quantity of the magnesium oxide that was formed. Third, the mixing of such ingredients with the elastomer required a solvent and the use of the more expensive spheroidally shaped magnesium granules.

It is an object of this invention to overcome the above disadvantages.

BRIEF DESCRIPTION OF THE INVENTION

Finely divided silicon dioxide is mixed with an elastomer selected from the group consisting of a polybutadiene and teflon. Finely divided magnesium metal is mixed into this mixture to form the pyrotechnic.

According to an optional feature of this invention, greater sensitivity can be attained by adding an additional oxidizer, which can, for example, be ferric oxide, potassium perchlorate, or teflon.

The invention will be fully understood from the following detailed description.

DETAILED DESCRIPTION OF THE INVENTION

It has been learned that no other oxidizer is needed for the magnesium oxide-silicon dioxide reaction when these materials are finely divided and mixed into a binder of a polybutadiene or teflon in appropriate quantities and proportions. In this regard, this invention is an important improvement over the well-known "Si Mag" igniter, which utilizes silicone rubber as a source of oxygen for the reaction, and which involves the problems referred to above. The degree of insensitivity required for artillery shells can be attained, and this without requiring solvent-assisted mixing, or the use of spheroidal magnesium particles.

Polybutadiene is the preferred binder, and teflon is the next preferred. The binder may therefore be selected from the group consisting of polybutadiene, teflon, or a mixture thereof. Preferably, at least some polybutadiene will be used, and when teflon is used, it will also function as an oxidizer.

Four suitable examples are as follows:

EXAMPLE I

60% magnesium
28% silicon dioxide
12% polybutadiene

EXAMPLE II

45% magnesium
35% teflon
10% silicon dioxide
10% polybutadiene

EXAMPLE III

70% magnesium
15% potassium perchlorate
7.5% silicon dioxide
7.5% polybutadiene

EXAMPLE IV

40% magnesium
50% silicon dioxide
10% polybutadiene

Example IV is the presently-preferred formulation, having good stability and least magnesium relative to the silicon dioxide. Examples I and IV do not include additional oxidizers.

Example II utilizes teflon as a binder and also as an oxidizer.

Example III utilizes potassium perchlorate as an additional oxidizer. This is more sensitive than Examples I and IV.

The percentages are by weight in the examples. The magnesium content may vary from about 40% to about 70%. The silicon dioxide may makeup the remainder, and may vary from about 7.5% to about 60%. The binder content may vary from about 5% to about 20%, depending on the physical properties desired, regarding teflon when used along with polybutadiene as an oxidant.

These products are readily ignited, and are effective to deliver substantial exothermic heat. In fact, they can successfully be used as igniters for other less sensitive substances.

It is unnecessary to utilize expensive spheriodally-shaped magnesium granules, and instead of silicone rubber, less expensive silicon dioxide and binders such as polybutadiene and teflon can be used.

This invention is not to be limited to the examples described in the description, which are given by way of example and not of limitation, but only in accordance with the scope of the appended claims.

We claim:

1. A pyrotechnic composition consisting essentially of, by weight, between about 40% and about 70% of finely divided magnesium metal, between about 5% to about 20% of a binder selected from the group consisting of polybutadiene, teflon, and mixtures thereof, and between about 7.5% and about 60% of silicon dioxide to make 100%, said magnesium and silicon dioxide being fully divided and mixed into said binder.

2. A pyrotechnic composition acccording to claim 1 in which said composition further includes an additional oxidizer.

3. A pyrotechnic composition according to claim 2 in which said additional oxidizer is teflon or potassium perchlorate, or both.

4. A pyrotechnic composition according to claim 1 in which the magnesium, and silicon dioxide proportions are about 60% and about 28% respectively, and in which the binder is polybutadiene, whose proportion is about 12%.

5. A pyrotechnic composition according to claim 1 in which the magnesium and silicon dioxide proportions are about 45% to about 10% respectively, in which the binder is polybutadiene whose proportion is about 10%, and in which teflon is further included, whose proportion is about 35%.

6. A pyrotechnic composition according to claim 1 in which the magnesium and silicon dioxide proportions are about 70% and about 7.5%, respectively, in which the binder is polybutadiene whose proportion is about 7.5%, and in which potassium perchlorate is further included, whose proportion is about 15%.

7. A pyrotechnic composition according to claim 1 in which the magnesium and silicon dioxide proportions are about 40% and about 50%, respectively, and in which the binder is polybutadiene, whose proportion is about 10%.

* * * * *